United States Patent [19]

Weaver, III

[11] Patent Number: 4,953,830

[45] Date of Patent: Sep. 4, 1990

[54] RAILING ASSEMBLY

[75] Inventor: James R. Weaver, III, Miami, Fla.

[73] Assignee: Saftron, Inc., Miami, Fla.

[21] Appl. No.: 413,876

[22] Filed: Sep. 28, 1989

Related U.S. Application Data

[63] Continuation-in-part of Ser. No. 302,634, Jan. 27, 1988, abandoned.

[51] Int. Cl.[5] ..... E04H 17/14

[52] U.S. Cl. ..... 256/65; 256/59; 256/19

[58] Field of Search ..... 256/19, 65,.66, 59; 52/155

[56] References Cited

U.S. PATENT DOCUMENTS

| | | | |
|---|---|---|---|
| 3,080,149 | 3/1963 | Pilboue | 256/19 X |
| 3,507,081 | 4/1970 | Gallup | 52/155 X |
| 4,053,140 | 10/1977 | Clemens et al. | 256/19 |
| 4,146,212 | 3/1979 | Lermer | 256/65 |
| 4,461,461 | 7/1984 | Caron | 256/19 |

FOREIGN PATENT DOCUMENTS

| | | | |
|---|---|---|---|
| 3533282 | 4/1986 | Fed. Rep. of Germany | 256/19 |

*Primary Examiner*—Andrew V. Kundrat

*Attorney, Agent, or Firm*—Malloy & Malloy

[57] ABSTRACT

A railing, fence or like barrier structure formed from a plurality of lightweight, high-strength plastic or like material components, different ones of which are capable of being either injected molded or extrusion molded wherein the plurality of components are connected to one another and at least some of which incorporate a high-strength material reinforcement member formed on the interior thereof during its molding formation. A connecting assembly or alternately a locking assembly serves to interconnect and/or lock other structural components of the railing assembly to form a structure with a high degree of structural integrity and yet maintain a substantially lightweight construction.

14 Claims, 3 Drawing Sheets

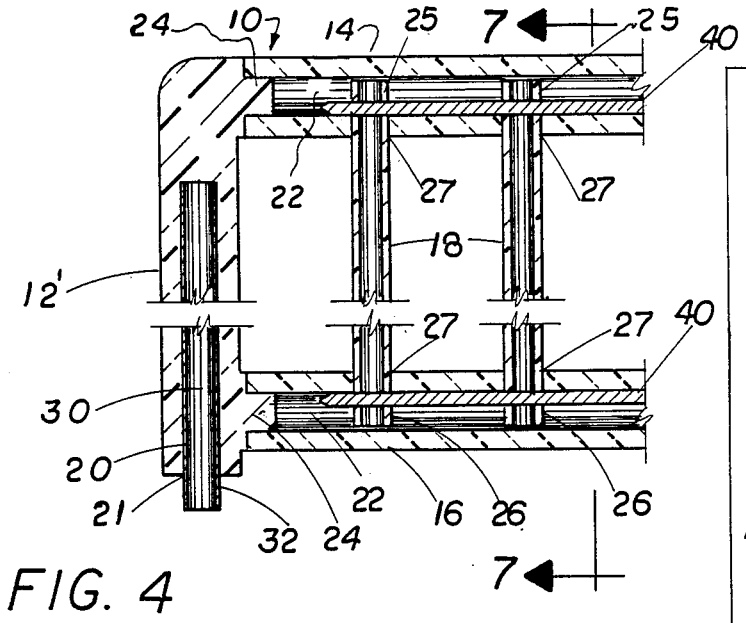
FIG. 4
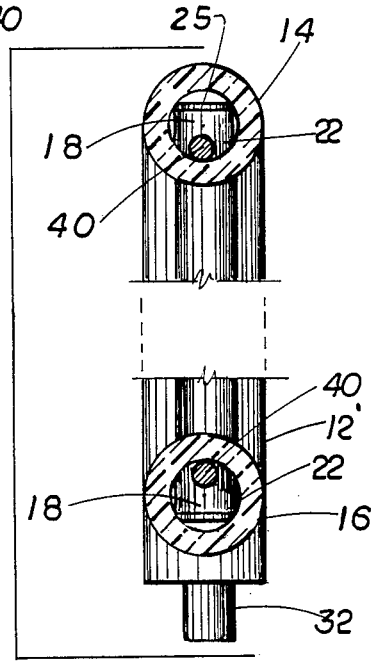
FIG. 7
FIG. 5
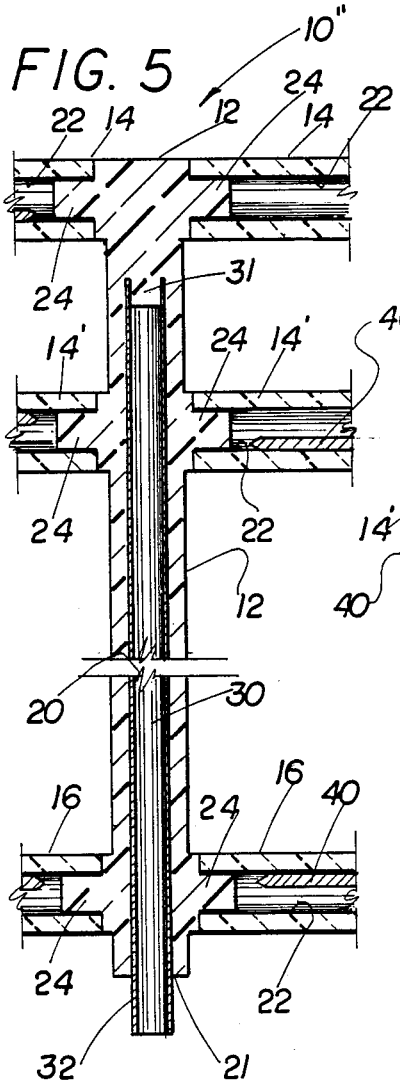
FIG. 6
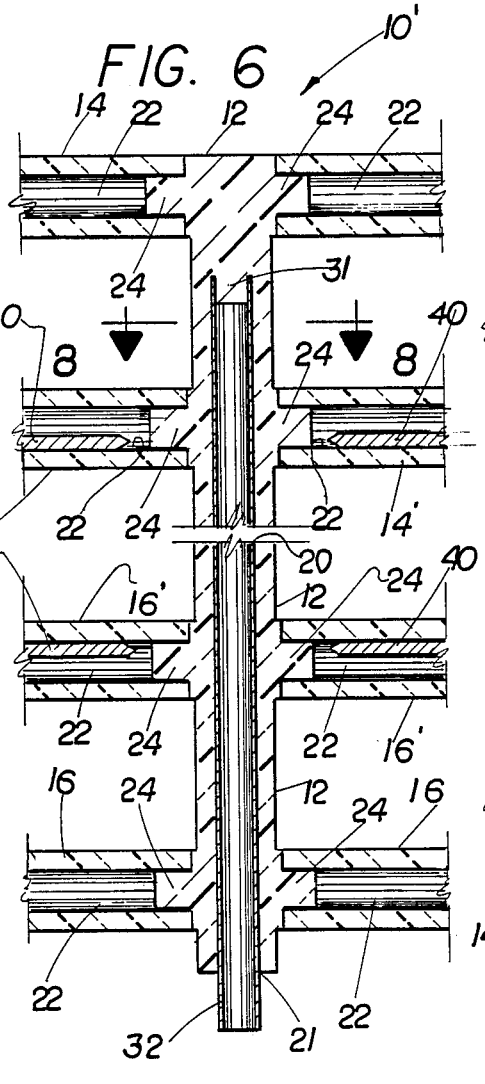
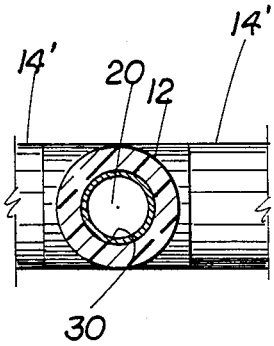
FIG. 8
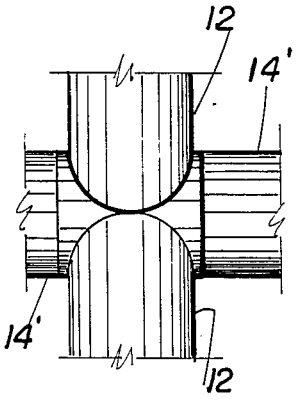
FIG. 9

FIG. 10
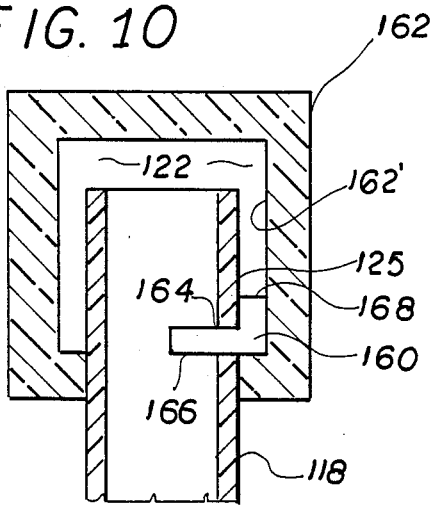
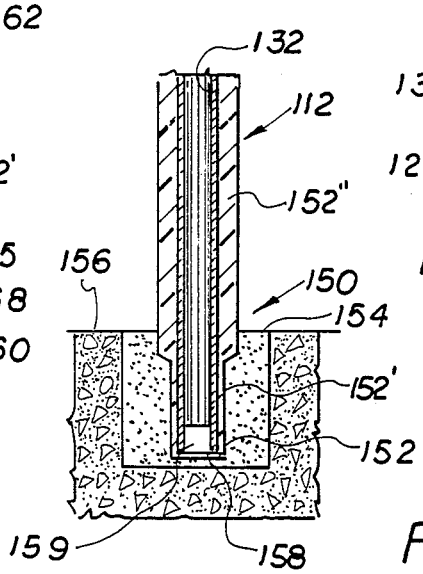
FIG. 11
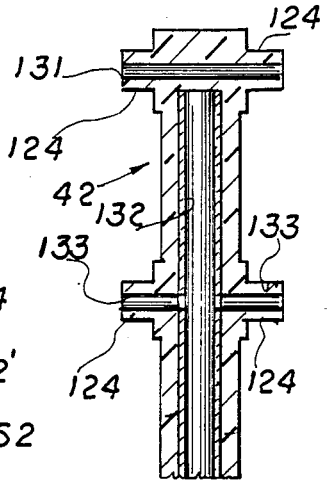
FIG. 12
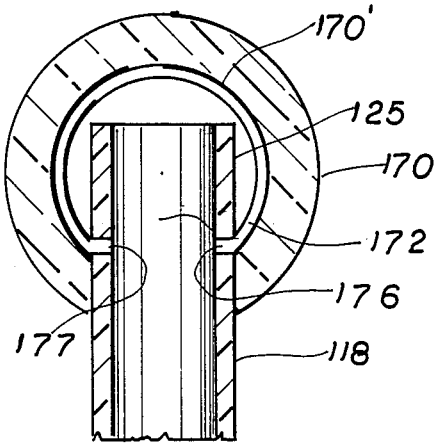
FIG. 13
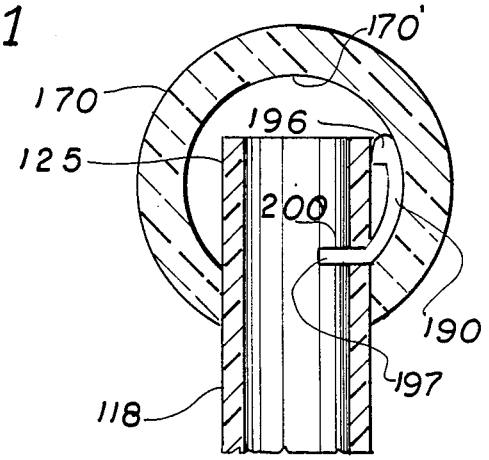
FIG. 15
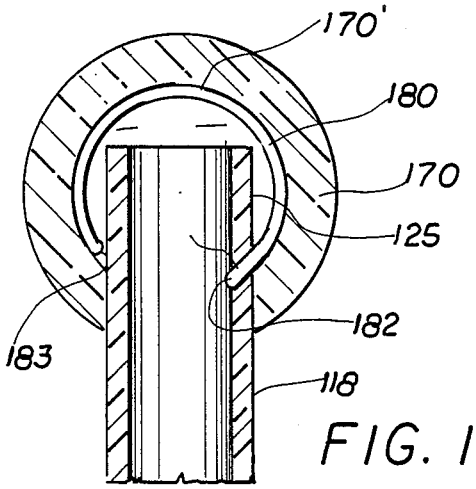
FIG. 14
FIG. 16
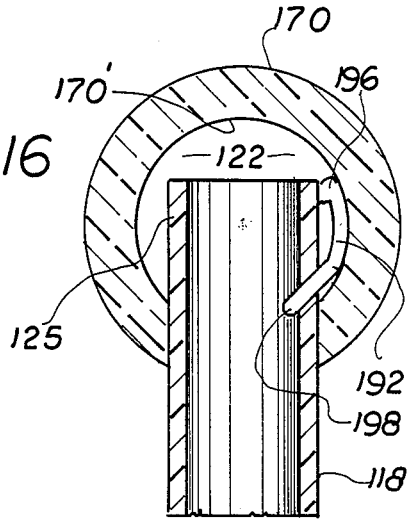

RAILING ASSEMBLY

This is a Continuation-In-Part Application of presently co-pending application Ser. No. 302,634 filed Jan. 27, 1988, now abandoned.

BACKGROUND OF THE INVENTION

1. Field of the Invention

The present invention is directed towards a railing, fence or like barrier assembly formed from a plurality of components which are interconnected to one another and wherein predetermined ones of such components are reinforced by high-strength material reinforcement members secured along the interior thereof.

2. Background of the Invention

Numerous types of railings, fences or like barrier structures are in use for a variety of specific applications. Typically, a railing may include a plurality of spaced apart pickets extending between and interconnected in supporting relation to spaced apart, substantially vertically oriented primary support members. Further, cross braces or the like may serve to interconnect the pickets as well as be connected at their opposite ends, to the primary, vertically oriented support members. The general design and configuration of such structures may vary depending upon the aesthetic appearance desired and the material from which the railing structure is formed. The majority of such prior art structures have the primary components thereof fixedly secured together and/or made from a one-piece construction. Structures of the prior art and of the type referred to herein are made from metal or wood and may enjoy sufficient strength but are generally considered to be overly heavy. To the contrary, if the metal or wood material from which such structures are formed is too light, the railing structure may be considered to be insufficiently strong to act as a barricade where desired.

Railings or like structures made from a plastic material are generally considered to be of light weight construction and of questionable strength for use in certain specific applications where a high strength barrier, fence or railing structure is required.

In light of the above, there is a need in this area for a railing structure or assembly formed preferably from a plastic, injection and/or extrusion molded material and including a plurality of components which are used in combination with a reinforcing structure or assembly. Such a preferred barrier assembly would be lightweight, facilitating installation and manufacture, easy to install and yet possess sufficient structural integrity or "high strength" qualities to be used as a barrier or railing structure in any of a wide variety of specific applications where both high strength and lightweight materials are desired or required.

Summary of the Invention

The present invention relates to a railing structure preferably formed from a plurality of plastic material components and interconnected to one another in a prescribed manner as set forth in greater detail hereinafter.

The barrier structure comprises a plurality of spaced apart, parallel and substantially vertically oriented support stanchions. The lower ends of such stanchions include means to anchor or penetrate into a supporting surface such as the ground, support flooring, etc. The interior of such support stanchions are structured to have formed thereon along a major portion of their length, an elongated reinforcement member.

The spaced apart, vertically oriented support stanchions are preferably interconnected by at least one upper cross brace having opposite ends of such cross brace connected to correspondingly positioned portions of the spaced apart but next adjacent support stanchions. The cross braces are formed by extrusion molding techniques and such cross braces are also hollow along all or at least a major portion of the length thereof. In various embodiments of the present invention the structural configuration of the subject railing may include a plurality of cross braces such as upper and lower pairs of cross braces extending between and connected to the next adjacent and spaced apart support stanchions at opposite ends of the cross braces.

In some of the contemplated embodiments, the railing structure includes a plurality of spaced apart, vertically oriented and substantially parallel picket having their opposite ends connected to spaced apart upper and lower cross braces. More specifically, the opposite ends of the pickets, while being disposed in spaced-apart, parallel relation to one another penetrate into the interior of respective ones of the cross braces by appropriately positioned apertures formed in such cross braces. A connecting assembly associated with the pickets is mounted within respective ones of the cross braces and when connected to the pickets, add to the structural integrity of the entire assembly.

Also, regardless of the embodiment utilized, a reinforcement means is used in combination with the support stanchions as set forth above. Such reinforcement means are used in the strengthening or supplementing of the structural integrity of the railing structure. An important feature of the present invention is the formation of the reinforcement member directly to the support stanchion during the injection molding thereof, thereby defining a unitary, one-piece construction of the reinforcement and the support stanchion. The securement of the aforementioned reinforcement member and support stanchion in this manner adds significant structural integrity or strength to the entire railing structure thereby increasing its utility and adaptability to a variety of different applications. Further, the reinforcement members include a hollow tubular construction, preferably formed of a high-strength metal or like material.

Another important feature of the present invention comprises a connecting assembly including a plurality of elongated solid material rods disposed on the interior of each of the aforementioned cross braces. Such rods have a significantly lesser diameter than the interior diameter of the cross braces in which they are mounted. Such dimensional ratio is generally in the range of approximately one quarter inch diameter of the connecting rods to approximately one and three-eighth inch inner diameter of the cross braces in which they are positioned. Each of the aforementioned rods pass through end portions of the plurality of pickets which are disposed on the interior of the cross braces in transverse or perpendicular relation thereto. By virtue of this connection of the connecting rods, the pickets are securely and fixedly locked to the cross braces.

The interconnection between the cross braces and the support stanchions occurs by a plurality of outwardly projecting fingers and receiving sockets or open ends respectively formed on the support stanchions and cross braces.

Other embodiments, to be described in greater detail hereinafter, include a lower most end of each of the stanchions having a tapered configuration which is embedded in a high strength grouting material. The grouting is encased within a support surface such as the ground or other material.

Yet further, a locking means is provided in the form of an extrudable material strip disposed with in the hollow interior of the cross braces and extending along the length thereof. At least one, but in certain embodiments, oppositely disposed longitudinal free end of the strips engage ends of the pickets which penetrate into the interior of the cross braces. Such engagement serves to firmly lock and maintain intended positioning of the pickets relative to the cross braces in the preferred orientation relative to one another and to the stanchions.

Brief Description of the Drawings

For a fuller understanding of the present invention, reference should be had to the following detailed description taken in connection with the accompanying drawings in which:

FIG. 4 is a sectional view in partial cut-away along line 4—4 of FIG. 1.

FIG. 5 is a sectional view in partial cut-away along line 5—5 of FIG. 1.

FIG. 6 is a sectional view in partial cut-away along line 6—6 of FIG. 2.

FIG. 7 is a sectional view in partial cut-away along line 7—7 of FIG. 4.

FIG. 8 is a sectional view in partial cut-away along line 8—8 of FIG. 6.

FIG. 9 is a detail external view in partial cut-away about line 9 of FIG. 2.

FIG. 10 is a sectional view in partial cut-away of another embodiment directed to a locking structure of the present invention.

FIG. 11 is a sectional view in partial cut-away of a lower most end of a stanchion and its attachment or anchoring to a supporting surface.

FIG. 12 is a longitudinal sectional view in partial cut-away of a reinforcement structure associated with each of the stanchions.

FIG. 13 is a sectional view in partial cut-away of yet another embodiment of the locking structure between a picket and a cross brace.

FIG. 14 is a sectional view of yet another embodiment in cross-section and partial cut-away of the locking structure between the picket and the cross brace.

FIG. 15 is a sectional view of yet another embodiment of the locking structure between the picket and the cross brace.

FIG. 16 is a sectional view in partial cut-away of yet another embodiment of the locking structure between the picket and the cross brace.

Like reference numerals refer to like parts throughout the several views of the drawings.

Detailed Description of the Preferred Embodiment

Figure 1:
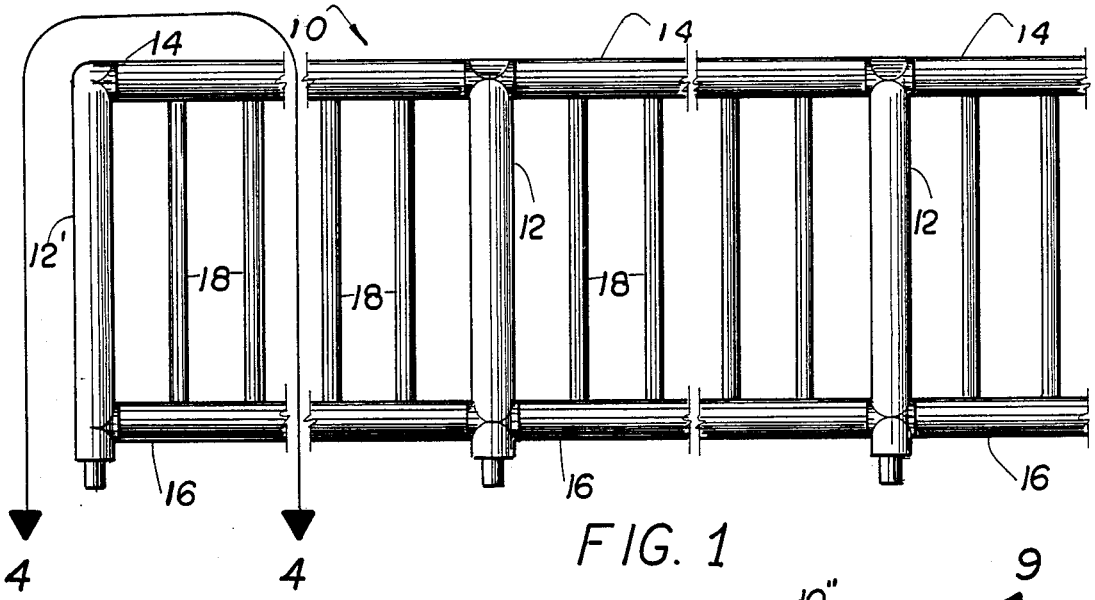
FIG. 1 is a front view in partial cut-away of one embodiment of the present invention.

As shown in FIGS. 1 through 9, the present invention is directed to a railing structure 10 or 10' in two structurally different embodiments. Each of the embodiments of the railing structure 10 or 10' include a plurality of substantially vertically oriented spaced apart and generally parallel support stanchions 12 wherein endmost support stanchions as at 12' are so indicated in that they define the free end of the railing 10 or 10' as versus the intermediate support stanchions 12 as clearly shown in FIGS. 1, 2 and 3. In each of the embodiments shown, the railing structure includes at least one upper cross brace 14 having opposite ends thereon connected between spaced apart but next adjacent stanchions 12', 12, or 12, 12.

The cross braces 14, 14' and 16, 16' are each secured at opposite ends thereof to the stanchions 12 and/or 12' by means of outwardly projecting fingers 24 defining an attachment means. Such interconnection occurs due to the fact that the opposite ends of each of the cross braces are open so as to receive the outwardly projecting fingers 24 therein.

All of the cross braces are preferably formed from extrusion molding techniques and include a hollow interior along their lengths. While the actual location of the one cross brace 14 may vary, there should be at least one such cross brace as at 14 interconnecting adjacent but spaced apart ones of the support stanchions 12', 12. The various embodiments of FIGS. 2 through 6 show a number of different combinations of cross braces 14 and 16 disposed in spaced apart relation to one another used in combination with vertically oriented spaced apart pickets 18. Further, in one preferred embodiment of FIGS. 1 and 4, there exists the upper cross brace 14 and the lower cross brace 16 interconnected by a plurality of spaced apart vertically oriented pickets 18 as shown.

Figure 2:
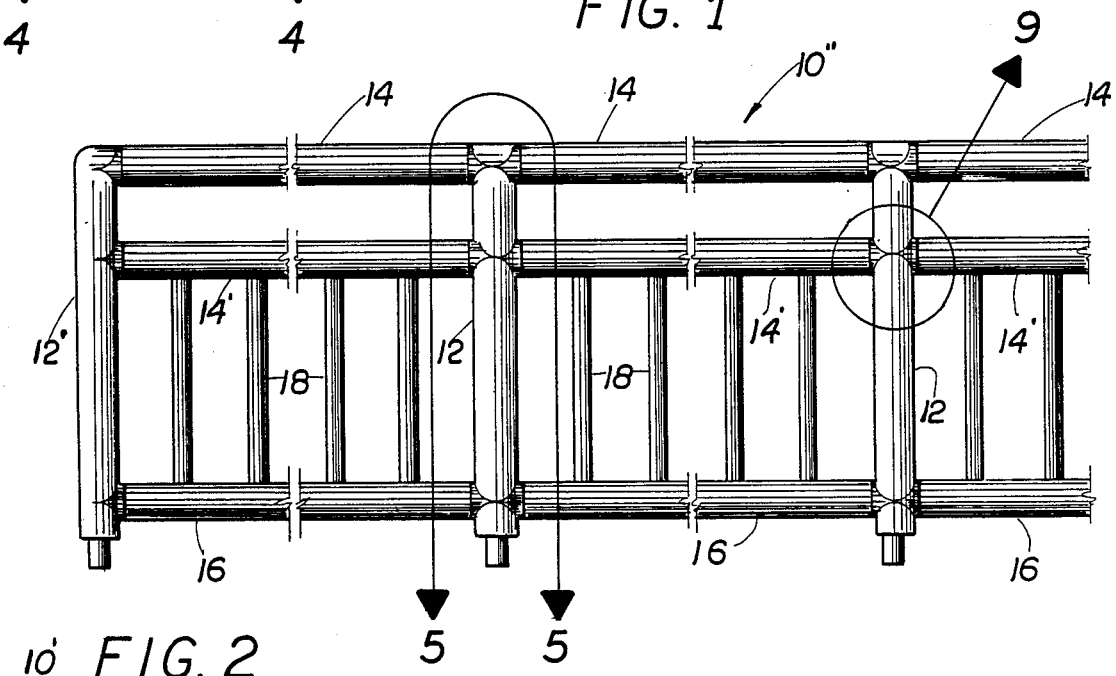
FIG. 2 is a front view in partial cut-away of another embodiment of the present invention.
Figure 3:
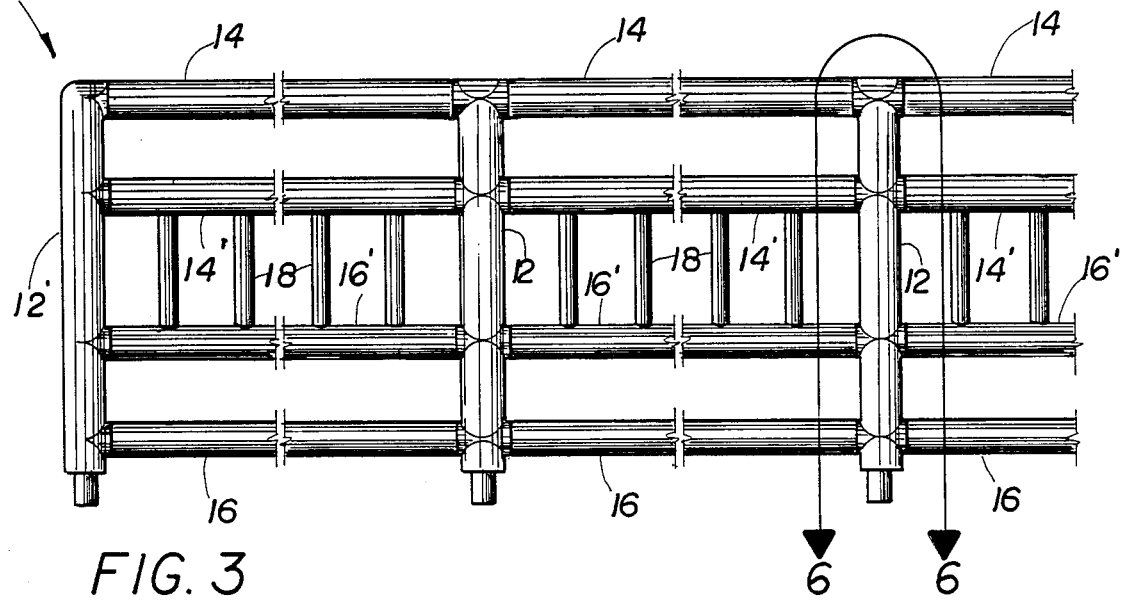
FIG. 3 a front view in partial cut-away of yet another embodiment of the present invention.

The embodiment of FIG. 3 differs from that of the embodiments of FIGS. 1 and 2 in that there exists upper and lower pairs of cross braces 14, 14' and 16, 16' respectively. Yet another alternate embodiment is shown in FIG. 2 wherein there exists an upper pair of cross braces 14, 14' and a single lower cross brace 16. In all of the embodiments shown, there further exists a plurality of spaced apart substantially vertically oriented pickets 18 disposed in substantially parallel relation to the support stanchions 12, 12' but spaced therefrom. It should be emphasized however that important structural features of the present invention could be incorporated into a railing structure that has no such pickets. However, the pickets, and particularly a connecting assembly, incorporated to lock the opposite ends of the picket to the correspondingly positioned cross braces is an important feature of the present invention.

Interconnection between the stanchions 12' and 12 and the cross braces 14, 14', and 16, 16' is defined by attachment means comprising a plurality of specifically disposed and integrally formed outwardly extending fingers 24 dimensioned to fit within open ends of the cross braces as shown in FIGS. 4, 5 and 6. Fixed interconnection in this manner may be insured by the inclusion of some type of adhesive or bonding agent therebetween to insure a permanent attachment.

Similarly, with regard to interconnection of the pickets 18 with the cross braces 14, 14' and/or 16, 16', reference is directed to FIG. 4. Opposite ends as at 25 and 26 of each of the pickets 18 are disposed to extend into the interior 22 of the next adjacent cross braces through appropriately formed apertures or the like 27. Securement of each of the pickets 18 with the cross braces is insured by their further locking interconnection with the connecting rods 40 defining a connecting means between opposite ends of the pickets 18 and the cross brace to which they are attached.

The connecting means of the present invention comprises a plurality of such connecting rods 40 in the form of elongated substantially solid material rods or the like. Preferably, the rods 40 are formed from a high strength metal but may be formed from a variety of high strength materials capable of serving the intended function of increasing the structural integrity of the constructed railing 10, 10' or 10''. As shown in FIGS. 4, 5, 6 and 7, the elongated rods 40 are of a significantly lesser diameter than the interior diameter of the cross braces in which they are located. Further, the length of the rods 40 are such as to extend along at least a majority and preferably substantially the entire interior length of the cross braces in which they are mounted, regardless of the embodiment of the railing utilized.

The existence of the connecting rods 40 serves to provide additional structural integrity to the cross braces by insuring a fixed, locked interconnection of the pickets 18 in the aforementioned manner with correspondingly positioned cross braces as shown in FIG. 4. More specifically, the reinforcement rods 40 pass through the opposite, inwardly positioned ends 25 and 26 of each of the pickets and are further disposed into abutting or confronting relation with a correspondingly positioned portion of the inner surface of the interior channel 22 of each of the cross braces in which they are positioned. As shown in FIGS. 5 and 6, certain ones of the cross braces as at 14 and 16 which are not connected to the picket, do not contain the connecting rods 40 therein.

An important feature of the present invention is the existence of the stanchions 12 or 12' with a reinforcement member 30 formed on the interior thereof and extending along the length thereof. Each of the reinforcement members 30 comprises an elongated hollow metal or like high-strength material tube. The reinforcement member 30 and the respective stanchion 12 or 12' in which it is formed is constructed utilizing injection molding techniques and effectively molding the stanchion about the exterior surface of the reinforcement member 30 during the injection molding process The result is a substantially integral, unitary, one-piece construction since the plastic material stanchions are effectively molded to the exterior surface of the reinforcement tube 30. The closed or inner end of the tube may include a plug member as at 31 in order to prevent the inflow of plastic melt passing into the interior of the reinforcement tube 30. The opposite end as at 32 may project outwardly from the end of the stanchion 12 or 12' as shown in the figures and may be used to anchor or otherwise secure the railing and particularly each of the stanchions to a supporting surface or structure.

As set forth above, the remaining components including the pickets 18 and each of the various cross braces 14, 16, etc. may be best formed by extrusion molding techniques as is well known.

Another embodiment of the present invention is shown in detail in FIG. 11 and includes a lower most end of the stanchion generally indicated as 112 including a hollow interior having a reinforcement member 132 bonded to the interior surfaces thereof by means of injection molding the plastic material stanchion directly to the outer surface of the reinforcement member 132. However, the lower end as at 150 is defined by a lower most or distal end of the stanchion as at 152 having a tapered configuration itself being defined by a reduced thickness as at 152' of the wall of the stanchion 150 over the remainder of the wall 152'' as clearly shown in FIG. 11. The anchor means 150 is further defined by a high strength grouting material 154 encasing the lower tapered end 152 as shown and further wherein the encasing grouting 154 as well as the lower end is effectively embedded within any type of ground or other supporting surface 156. Other features of the embodiment of FIG. 11 include the stanchion 112 having a closed lower end 158 which serves to overly and effectively cover or close the open lower end of the reinforcement member 132. To this end, a plug as at 159 also is positioned prior to the injection molding formation four bonding between the stanchion 112 and the reinforcement member 132.

FIG. 12 represents yet another embodiment of a stanchion structure generally at its upper end wherein the reinforcement member 132 extends along substantially the entire length of the stanchion 112. Means to attach the cross braces at the opposite ends of such cross braces include outwardly extending fingers 124 disposed at various spaced apart locations along the length of the stanchions 112. The outwardly extending fingers 124 are disposed at each point of junction where the cross braces engage and are connected to the stanchions. Suffice it to say that the structure shown in FIG. 12 is an intermediate cross brace rather than an end most cross brace as shown in FIG. 4. In the embodiment of FIG. 4, the fingers 24 extend outwardly only from one side so as to receive the correspondingly positioned ends of the cross braces 14 and 16.

Also, each of the cross braces includes channels extending through the fingers as at 131 and 133 for the passage therethrough of the rods as at 40 discussed with regard to the embodiment of FIG. 6 and 7.

With regard to the additional embodiments of FIGS. 10 and 13 through 16, the present invention further contemplates the provision of locking means in the form of a locking strip 160 having an elongated configuration and formed of an extrudable material. In the embodiment of FIG. 10, the picket 118 has at least one of its opposite ends 125 extending into the interior 122 of a cross brace as at 162 which may have a square or rectangular cross-sectional configuration as shown. Locking firm engagement of the end 125 of picket 118 is ensured by the fact that the end 125 has a cutout portion including at least one cutout 164 formed in one side thereof so as to receive one leg 166 of the locking strip 160. The opposite leg as at 168 is disposed in confronting engagement with inner surface portions 162' of the cross brace 162 as shown. In the embodiment shown in FIG. 10, the cutout 164 essentially is disposed at 90° or right angles to the length of the picket 118. In the embodiment of FIG. 13, the cross brace has a hollow interior configuration extending along its length wherein the cross brace 170 has a substantially round or circular cross-sectional configuration. Locking strip 172 has a curvilinear configuration along the majority of its transverse dimension which is disposed in confronting engagement with the inner surface portion of the cross brace 170 as at 170'. The picket 118 has one of its opposite ends 125 disposed on the interior 122 of the cross brace 170 and has two spaced apart cutouts 174, each disposed to receive a portion of the correspondingly positioned opposite longitudinal free ends 176 and 177 of the elongated locking strip 172.

Similarly, the embodiment of FIG. 14 has an elongated curvilinear configuration along the transverse dimension of the locking strip 180 wherein one free longitudinal end or edge as at 182 is disposed in receiving, locking engagement within an angularly disposed cutout 184. The cutout 184, as clearly shown in FIG. 14, is disposed at an angle somewhat less than 90° as versus the 90° cutouts 174 as shown in FIG. 13. The opposite free end as at 185 of the locking strip 180 is disposed substantially between an outer surface of the end 125 of the picket 118 and the internal surface portion 170' of the cross brace 170.

The embodiments of FIGS. 15 and 16 are somewhat similar in that each of the locking strips 190 and 192 respectively include a curvilinear transverse configuration wherein one free longitudinal end 194 and 196 respectively of each strip 190 and 192 is effectively sandwiched between an outer surface of the end 125 of picket 118 and the inner surface 170' of the cross brace 170. The opposite end of the respective locking strips 190 and 192 as at 197 and 198 are received within cutouts 200 and 201. In the embodiment of FIG. 15, the cutout 200 is disposed at 90° or right angles to the length of the picket 118 wherein in the embodiment of FIG. 16, the cutout 201 is disposed at an angular orientation somewhat less than 90° as clearly shown.

Now that the invention has been described,

What is claimed is:

1. A railing assembly formed from a plurality of interconnected components of moldable material, said assembly comprising:

a. a plurality of spaced apart, vertically oriented elongated support stanchions each having a hollow interior extending along the length thereof and including a lower end adapted to be anchored to a support surface, b. at least one cross brace having opposite ends thereof connected to spaced apart, next adjacent ones of said support stanchions disposed at said opposite ends of said cross brace, c. each of said plurality of support stanchions including reinforcement means formed thereon for strengthening thereof and comprising an elongated, high strength material reinforcement member secured continuously to each stanchion along the length of said reinforcement member, d. each of said plurality of stanchions formed by injection molding the length thereof in bonded engagement with an exterior surface of a different one of said reinforcement members to define an integral, unitary construction therewith, e. each of said stanchions including an anchor means for securing said lower end to the support surface at least partially defined by a tapered lower end portion having a reduced wall thickness of each stanchion at said lower end relative to the thickness of a remainder of a wall of said stanchion, f. said assembly further comprising a plurality of cross braces, each connected at opposite ends thereof to adjacent ones of said stanchions in transverse relation thereto and each cross brace having a hollow configuration along its length; a plurality of pickets disposed in spaced, parallel relation to one another and to said stanchions and each picket having an opposite end thereof extending into said hollow interior of a correspondingly positioned one of said cross braces, and g. said assembly including locking means securing said pickets to said cross braces and including an elongated strip of extrudable material disposed on the interior of said cross brace in confronting engagement with interior surface portions thereof, each of said strips comprising at least one free longitudinal edge disposed in locking engagement with correspondingly positioned ends of said plurality of pickets in spaced apart locations along said longitudinal edge.

2. An assembly as in claim 1 wherein each of said correspondingly positioned ends of said plurality of pickets include cutout portions formed therein and dimensioned and disposed to receive said longitudinal edges therein.

3. An assembly as in claim 2 wherein said cutout portions comprise at least one substantially square cutout disposed substantially 90° to the length of the picket in which it is formed.

4. An assembly as in claim 2 wherein said cutout portions comprise at least two square cutouts, each disposed substantially 90° to the length of the picket in which it is formed and each disposed on opposite sides of said picket relative to one another.

5. An assembly as in claim 4 wherein each of said elongated strips comprises a substantially curvilinear, cross-sectional configuration disposed in confronting engagement with an interior surface portion of said cross brace in which it is formed and opposite free longitudinal edges of said strip disposed within different ones of said two cutouts.

6. An assembly as in claim 2 wherein said strip comprises a substantially L-shaped, cross-sectional configuration including a first leg disposed exteriorly of said cutout portion in confronting engagement with an interior surface portion of said cross brace in which it is mounted and a second leg defining said longitudinal edge.

7. An assembly as in claim 2 wherein said cutout portion comprises at least one cutout disposed at a substantially angular orientation relative to the length of the picket in which it is formed.

8. An assembly as in claim 7 wherein said first leg has a substantially curvilinear configuration in an outer end which is sandwiched between said pickets and said inner surface portion of said cross-brace.

9. An assembly as in claim 2 wherein said strip has a substantially curvilinear cross-sectional configuration disposed in confronting engagement with an inner surface portion of said cross brace and one free longitudinal end disposed within said cutout portion, said cross-section of said strip having a sufficient longitudinal dimension to extend substantially along a majority of said inner surface portion in confronting relation thereto.

10. An assembly as in claim 14 further comprising a plurality of pickets, each having an elongated configuration being connected and extending in transverse relation to said one cross brace in spaced, parallel relation to one another and to said stanchions, said one cross brace having a hollow interior along its length and connecting means mounted within said one cross brace and extending along the length thereof into locking engagement with each of said plurality of pickets within said hollow interior of said one cross brace.

11. An assembly as in claim 10 wherein said connecting means comprises an elongated connecting rod disposed within said one cross brace to which said pickets are connected and into penetrating, locking engagement with the ends of each of said plurality of pickets disposed within said one cross brace, said connecting rod being further disposed in confronting relation to an interior surface of said one cross brace along the length of said connecting rod.

12. An assembly as in claim 11 further comprising a plurality of cross braces each comprising a hollow interior extending along the length thereof; said connecting means comprising an elongated connecting rod mounted within and extending along the length of each cross brace, correspondingly positioned opposite ends of said plurality of pickets extending into the interior of correspondingly positioned cross braces at spaced apart locations along the length of said cross braces, each of said connecting rods extending through correspondingly positioned ends of a plurality of adjacently positioned pickets connected to respective ones of said cross braces.

13. An assembly as in claim 12 wherein each of said connecting rods comprises a solid material rod of lesser diameter than an inner diameter of said cross braces and disposed in confronting engagement with the inner surface of respective ones of said cross braces along the length of said connecting rods.

14. A railing assembly formed from a plurality of interconnected components of moldable material, said assembly comprising:

a. a plurality of spaced apart, vertically oriented elongated support stanchions each having a hollow interior extending along the length thereof and including a lower end adapted to be anchored to a support surface, b. at least one cross brace having opposite ends thereof connected to spaced apart, next adjacent ones of said support stanchions disposed at said opposite ends of said cross brace, c. each of said plurality of support stanchions including reinforcement means formed thereon for strengthening thereof and comprising an elongated, high strength material reinforcement member secured continuously to each stanchion along the length of said reinforcement member, d. each of said plurality of stanchions formed by injection molding the length thereof in bonded engagement with an exterior surface of a different one of said reinforcement members to define an integral, unitary construction therewith, e. each of said stanchions including an anchor means for securing said lower end to the support surface at least partially defined by a tapered lower end portion having a reduced wall thickness of each stanchion at said lower end relative to the thickness of a remainder of a wall of said stanchion, f. said anchor means including an anchor member dimensioned and configurated to surround and at least partially encase said tapered lower portion, g. said lower end of each stanchion being closed and in overlying, covering relation to a corresponding lower end of said reinforcement member, h. each of said reinforcement members comprises an elongated hollow tubular configuration having an open lower distal end disposed on the interior of a corresponding one of said stanchions, and i. a plug formed within said open lower end of each reinforcement member in closing relation thereto.

* * * * *